United States Patent [19]

King et al.

[11] Patent Number: 4,498,570

[45] Date of Patent: Feb. 12, 1985

[54] MULTIPLE PURCHASE DISCOUNT MODULE FOR A SINGLE PRICE VENDING MACHINE

[75] Inventors: Eddie W. King; Annis R. Morgan, Jr., both of Atlanta, Ga.

[73] Assignee: The Coca-Cola Company, Atlanta, Ga.

[21] Appl. No.: 343,905

[22] Filed: Jan. 29, 1982

[51] Int. Cl.[3] ..... G07F 9/08

[52] U.S. Cl. ..... 194/1 N; 194/10

[58] Field of Search ..... 194/1 M, 1 N, 10, DIG. 3, 194/DIG. 4

[56] References Cited

U.S. PATENT DOCUMENTS

| | | | |
|---|---|---|---|
| 3,722,649 | 3/1973 | Pfitzer | 194/1 M X |
| 3,815,720 | 6/1974 | MacHanian et al. | 194/1 N X |
| 4,008,792 | 2/1977 | Levasseur et al. | 194/1 N |
| 4,013,157 | 3/1977 | Britz et al. | 194/1 N |
| 4,267,915 | 5/1981 | McLaughlin et al. | 192/2 X |
| 4,376,479 | 3/1983 | Sugimoto et al. | 194/1 N |

*Primary Examiner*—F. J. Bartuska

*Attorney, Agent, or Firm*—Birch, Stewart, Kolasch & Birch

[57] ABSTRACT

A vending machine includes a switching device for establishing a first price for a first item sold during a sales transaction and for establishing at least a second price for additional items sold in the same transaction. The machine determines the amount of currency deposited during a transaction and the maximum number of items which may be purchased during the transaction based upon the amount deposited. The purchaser may freely select the number of items to be purchased at any time.

17 Claims, 5 Drawing Figures

MULTIPLE PURCHASE DISCOUNT MODULE FOR A SINGLE PRICE VENDING MACHINE

BACKGROUND OF THE INVENTION

1. Field of the Invention

The present invention relates to a single price electromechanically actuated vending machine including an electronic multiple purchase module giving the machine the capability of selling products at a discount if purchased collectively during a single sales transaction. More specifically, the discount module of the present invention enables the vending machine to sell products in one-for, two-for, or three-for combinations during a single sales transaction or vend cycle.

2. Description of the Prior Art

Heretofore, attempts have been made to offer discount prices for vended products purchased in large quantities as an inducement to customers to purchase more products. Various systems have been designed and implemented for providing vending machines with this capability, but none of these systems of the prior art have had the requisite simplicity and low cost to facilitate retrofitting into existing state of the art coin-operated vending machines. One example of a prior art device of this general type is disclosed in U.S. Pat. No. 4,008,792 to Levasseur, et al. The Levasseur Patent describes a vending machine control circuit, including solid state control circuitry, and it alludes to the desirability of providing discount prices for products purchased in large quantities. A general description of the implementation of discount pricing in the Levasseur system is described in column 8, lines 3 to 20. However, this description merely addresses the desirability of providing discount pricing, and does not disclose a specific embodiment of how discount pricing could be effected by retrofitting state of the art vending machines. Accordingly, the Levasseur Patent is merely evidence of a need in the art for the development of a satisfactory system for providing discount pricing for vending machines.

SUMMARY OF THE INVENTION

Accordingly, it is a primary object of the present invention to provide a discount module for a single price vending machine which may be retrofitted into existing state-of-the-art vending machines at a minimal conversion cost.

It is another object of the present invention to provide a discount module for a single price vending machine which provides a discount price for multiple purchases of products made during a single sales transaction.

It is still another object of the present invention to provide a discount module for a single price vending machine which permits a customer to make a random choice of a plurality of differnt products during a multiple purchase transaction.

It is a further object of the present invention to provide a discount module for a vending machine in combination with price-setting switches operated by a serviceman for pre-setting the price of the first product to be purchased and the price of each subsequent product purchased during the multiple purchase sales transaction, the switches being individually set for each respective product.

It is still a further object of the present invention to provide a multiple purchase discount module for a vending machine which may be selectively pre-set by a serviceman to provide a one-for, two-for, or three-for sales capability as a function of pre-set price settings of individual switch groups associated with the first, second and third product to be vended.

It is yet another object of the present invention to provide a multiple purchase discount module for a vending machine wherein the accumulation of a maximum amount of escrow credit in excess of a one-for, two-for or three-for price setting precludes the coin acceptor of the vending machine from accepting any more coins.

It is still another object of the present invention to provide a multiple purchase discount module for a vending machine wherein the selection of one or more products stops any further credit escrow and acceptance of coins.

It is still a further object of the present invention to provide a discount module for a vending machine which only permits the refund of coins or money up to the accumulation of the first to be vended product price, or if a total machine sold-out condition occurs during the sales transaction, partial sold-out conditions requiring the choice of other products.

It is still another object of the present invention to provide a discount module for a vending machine which requires that a product selection be made once any predetermined level of sales credit associated with one or more products is accumulated, no refund being available under these conditions.

It is yet another object of the present invention to provide a customer interface display means for instructing a customer with respect to price information, sales transaction status and change status during a product vend cycle.

It is still another object of the present invention to provide a multiple purchase discount module for a vending machine which has the capability of storing and reading out sales information with respect to the number of vends made at selected prices and the accuracy of data displayed as a function of satisfactory machine operability during the data acquisition period.

It is still a further object of the invention to provide a discount module for a vending machine including a reserve power system so that the escrow credit memory of the module will not be erased for up to twenty-four hours, if a power failure occurs in the main source of power.

It is still a further object of the present nvention to provide a discount module for a vending machine which may be interfaced with additional accessories such as a script currency validator to enable the machine to respond to script currency in addition to coins.

The foregoing objects of the invention are fulfilled by providing a coin or check-operated vending machine, including a plurality of products, all of which may be purchased for the same predetermined price if purchased individually during a single sales transaction, said vending machine having a multiple purchase discount module therein comprising:

price-setting means for establishing said same predetermined product price for the vend of a first product and a predetermined price for at least one additional product for when a plurality of products are collectively purchased during said same sales transaction, the price of said at least one additional product being less than said same predetermined product price;

accumulator means for receiving money during said single sales transaction and establishing credit toward the purchase of said products;

escrow memory means for storing escrow credit established by said accumulator toward the purchase of a first product and at least one additional product during a single sales transaction;

credit detector means for determining when said escrow credit is at least equal to said predetermined product price and when said escrow credit equals the total of said same predetermined product price and the price of said at least one additional product;

product selector means for requesting the vend of a first one or more of said products following the insertion of all money related to said single sales transaction; and vend discharge control means responsive to said credit detector means for enabling the vend of said first product if said credit detector means determines that the escrow credit established in said escrow means at least equals said same predetermined product price and additional products if said escrow detector means determines that said escrow credit is at least equal to the total of said same predetermined product price and said predetermined price of said at least one additional product during said single angle sales transaction.

The multiple purchase discount module of the present invention may be a replacement circuit for electronic modules presently utilized in combination with commercially available coin mechanisms. For example, the multiple purchase discount module of the present invention may be substituted for the electronic control module employed in Coin Co 9800 series coin mechanisms manufactured by Coin Acceptors, Inc. However, it should be understood that the multiple purchase discount module of the present invention may be utilized with other state of the art coin mechanisms without departing from the spirit and scope of the present invention.

BRIEF DESCRIPTION OF THE DRAWINGS

The objects of the present invention and the attendant advantages thereof will become more clearly understood by reference to the accompanying drawings wherein.

DETAILED DESCRIPTION OF THE PREFERRED EMBODIMENTS

Figure 1:
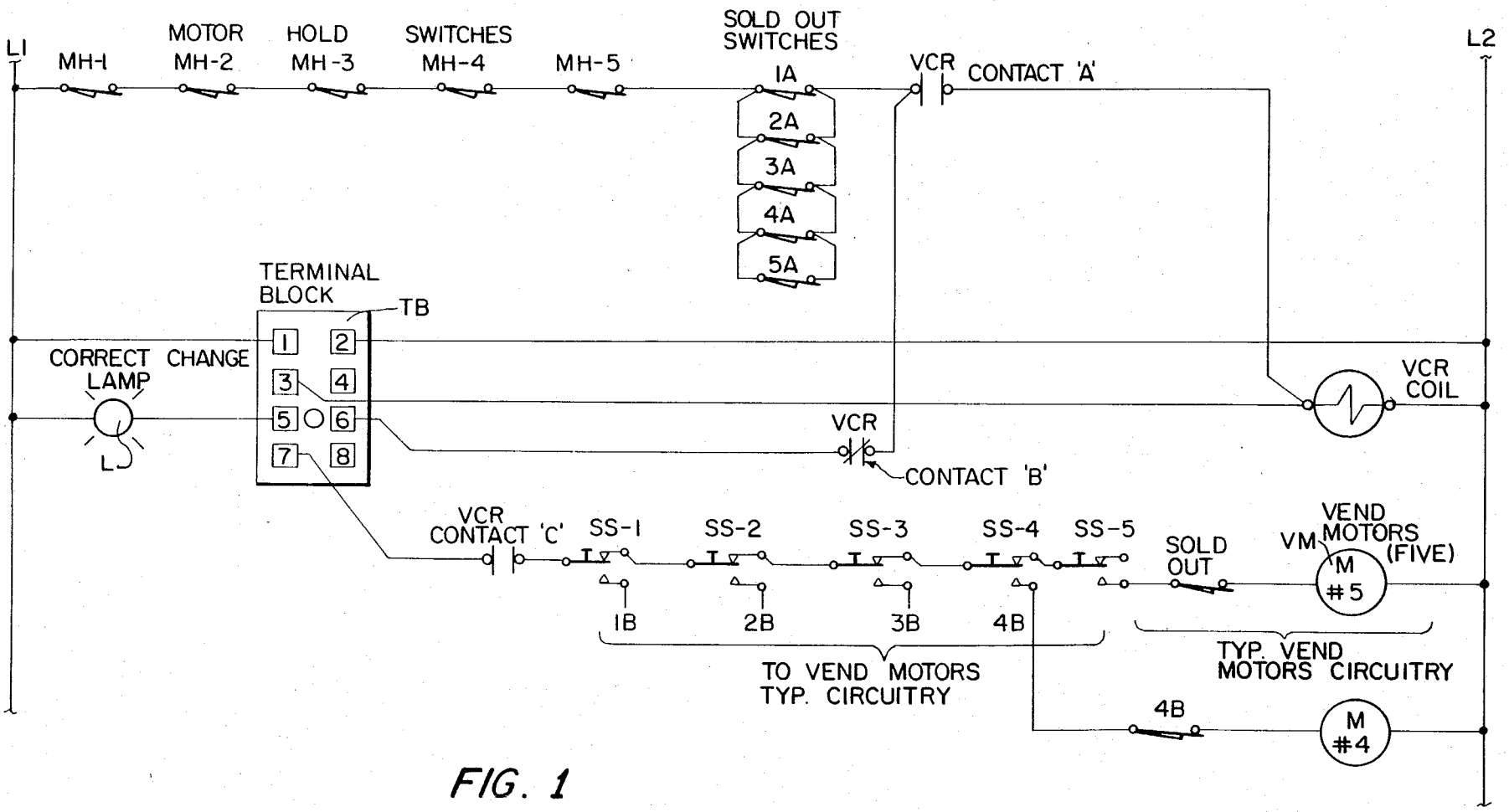
FIG. 1 PRIOR ART
FIG. 1 is a circuit schematic of the control circuitry of a typical vending machine into which the multiple purchase discount module of the present invention may be retrofitted.
Figure 2:
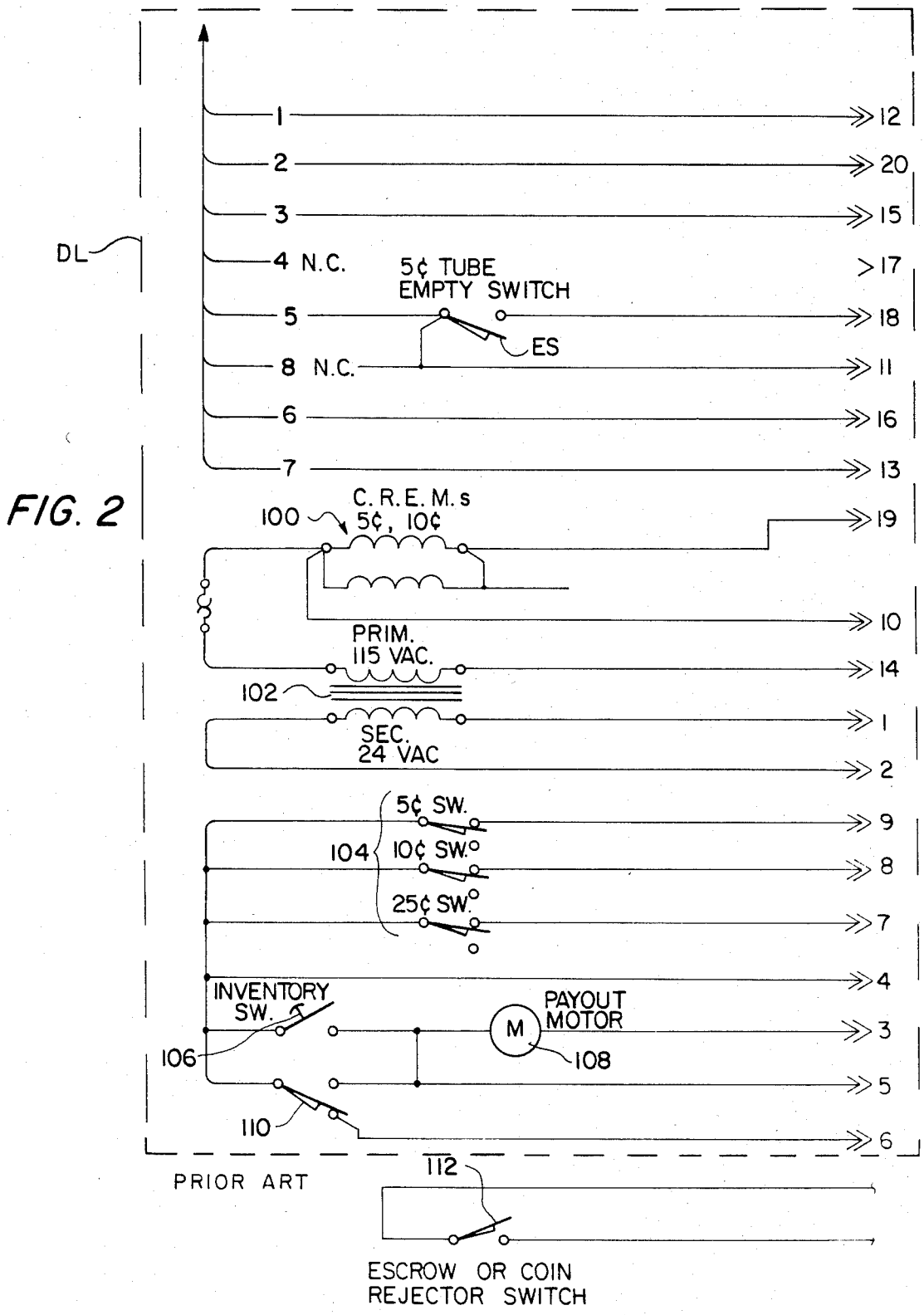
FIG. 2 is a circuit schematic of a typical coin mechanism for interfacing with the control circuit of FIG. 1.
Figure 3:
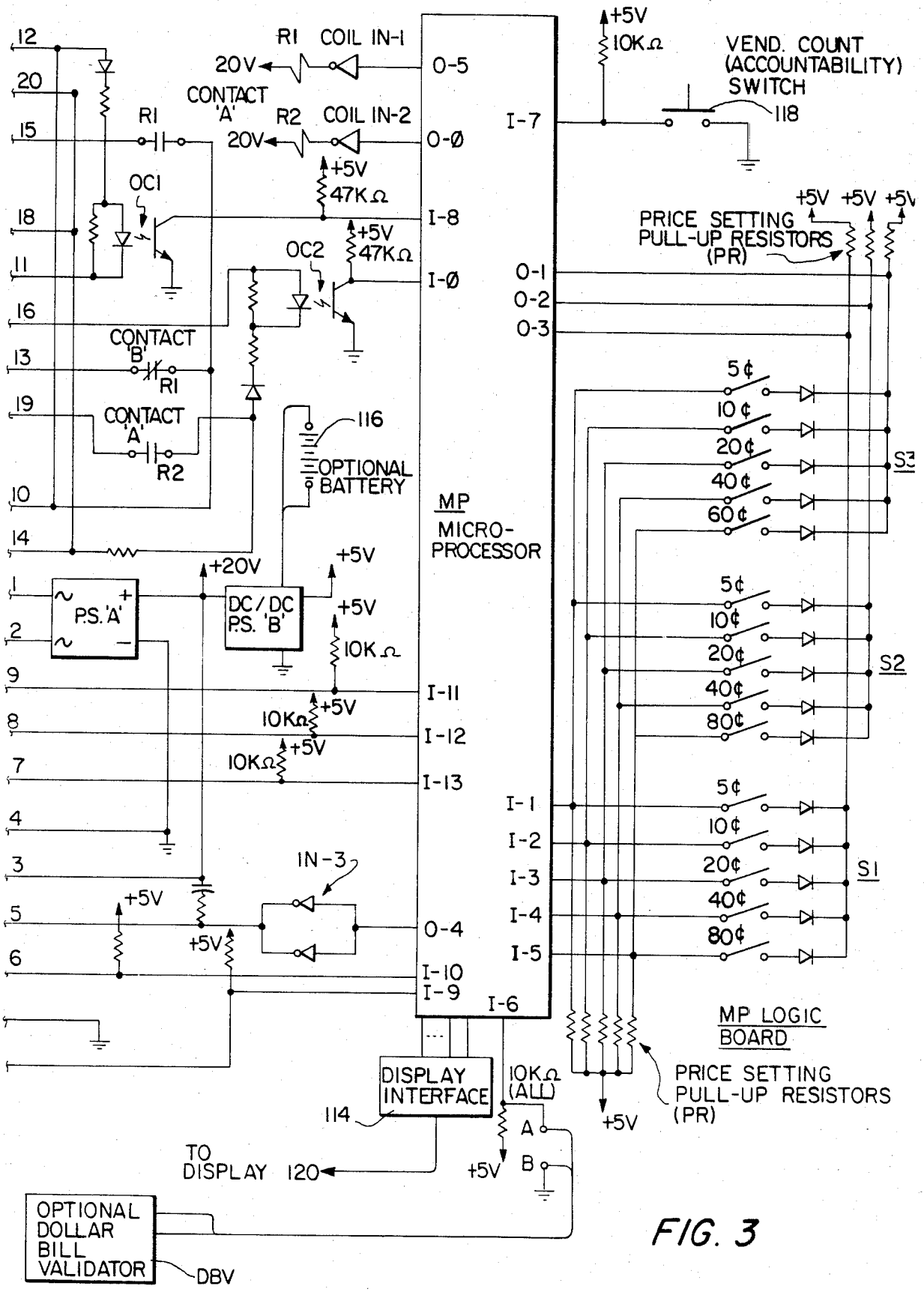
FIG. 3 is the multiple purchase discount module of the present invention which is interfaced with the coin mechanism of FIG. 2 at the terminal pins bearing like reference numerals.

The circuitry of the system of the present invention is illustrated by the combination of FIGS. 1 to 3. The respective circuits of these Figures are interfaced together by means of suitable terminal blocks and/or connectors. For example, the vending machine control circuitry of FIG. 1 and the coin mechanism of FIG. 2 are interfaced through a terminal block TB bearing commercial pin designation numbers 1 to 8, as illustrated. These commercial pin numbers correspond to those numbers of the 9800 Series of (Coin Co) coin mechanisms manufactured by Coin Acceptors, Inc. As stated hereinbefore, the use of a Coin Acceptors, Inc. 9800 Series coin mechanism is for the purpose of illustration only, if being understood that other forms of vending control circuits and coin mechanisms may be utilized within the spirit and scope of the present invention. The coin mechanism circuitry of FIG. 2 and the multiple purchase discount module circuitry of the present invention illustrated in FIG. 3 are interfaced along terminal pins 1 to 20 in the manner indicated. These terminal pins 1 to 20 are also the commercial pin designation numbers of the 9800 Series of Coin Acceptors, Inc. coin mechanisms.

FIG. 1 illustrates control circuitry for a typical vending machine for use with the present invention. Alternating current power is supplied to this circuit through lines L1, L2 and power is supplied via said lines to vending motor circuitry, sold-out switches, a vend credit relay VCR, a plurality of product selector switches, and a correct change indicator lamp. The motor control circuitry includes in the example illustrated, five vend motors VM, and five associated motor hold switches MH-1, MH-2, MH-3, MH-4, MH-5. There are also five sold-out switches with double contacts 1A,1B, 2A,2B 3A,3B 4A,4B 5A,5B associated with each of the respective vend motors in the circuit of FIG. 1 and five product selector switches SS1, SS2, SS3, SS4, SS5. The vend credit relay coil VCR has three sets of contacts A, B and C, as indicated. The operation of which will be described more fully hereinafter.

Referring in detail to FIG. 2, there is illustrated a typical coin mechanism such as a 9800 Series of Coin Acceptor, Inc., including input terminal pins 1 to 8 and terminal pins 1 to 20. The coin mechanism is provided with an empty switch ES for indicating when the mechanism is out of nickels, requiring the introduction of exact change, a plurality of coin- reject electromagnets (CREM) 100 for precluding acceptance of coinage into the vending machine when the CREMs are energized, a power supply transformer 102, a plurality of coin switches 104 for accepting and counting coins of 5, 10 and 25 cent denominations, an inventory switch 106, a coin pay-out motor 108, and a motor pulse carry switch 110. The portion of FIG. 2 within dashed line DL represents a typical mechanism such as the abovementioned 9800 series. An escrow or coin rejector switch 112 is added for use with the multiple purchase module of the present invention. The operation of the above-described components in conjunction with the system of the present invention will be more fully described hereinafter.

Referring in detail to FIG. 3, there is illustrated the multiple purchase discount module of the present invention which includes an electronic logic board including a microprocessor MP such as an MB8850, manufactured by Fairchild, Inc., a customer interface display 120 (see FIG. 4) and the display interface 114, an optional back-up battery 116 and a plurality of DIP switch banks S1, S2, S3 for setting the prices for first, second and third products purchased during a single sales transaction and in a manner to be described more fully hereinafter. The micro-processor MP is provided with a plurality of inputs designated with a prefix I and associated identifying suffix. These respective inputs and their functions in the circuitry will be described in detail hereinafter. The microprocessor MP also has a plurality of outputs designated by the prefix O and appropriate suffix. The circuitry components interfaced with the microprocessor chip MP will be described hereinafter in connection with the operation of the system of the present invention in accordance with the logic functions programmed into the microprocessor.

In addition, the multiple purchase module of the present invention will accept inputs from an optional dollar bill validator of any type commercially available.

The microcomputer of FIG. 3 makes logical comparisons between inputs received on the terminals marked I and an internal program in the microprocessor, and then controls the coin mechansim of FIG. 2 and the vender circuitry of FIG. 1 by way of the microprocessor outputs labeled O. The logic of the internal program within the microprocessor will be described in detail hereinafter under the heating "System Logic Functions".

DESCRIPTION OF OPERATION

Coin Acceptance 5¢, 10¢, 25¢

The Coin Rejector Electro-magnets (CREMs) are controlled by the microprocessor MP logic rather than by the vendor control circuitry of FIG. 1 as would be conventional in a single purchase vending machine.

In a conventional coin mechanism control vendor the CREMs which are located in the coin mechanism of FIG. 2 and labeled 100 are wired via a pin 6 of the coin mechanism terminal block TB to the sold-out switches 1A, 2A, 3A, 4A, 5A, the motor switches MH-1, MH-2, MH-3, MH-4, MH-5 and a normally closed contact B of the vend credit relay VCR.

With the traditional wiring of the CREMs, the coin mechanism of FIG. 2 would not accept coinage, i.e., the CREMs become de-energized when:

(1) a vend credit was established (i.e., VCR coil of FIG. 1 is energized); or (2) the vendor was sold out in all columns (i.e., all sold-out switches 1A to 5A are open).

Following the establishment of a vend credit, the traditional coin mechanism of a single-purchase vending machine refuses, via the CREMs, to accept further coinage until the sales transaction has been completed. With this traditional hard-wired logic, a sales transaction is not completed until a vend has occured (signaled by the opening of one of the respective motor hold switches MH-1 to 5).

In contrast to the traditional single-sales transaction vending machines described above, in the present invention the CREMs 100 are controlled by the logic in the microprocessor MP. The microprocessor MP controls the CREMs via output O-Φ. O-Φ forces an inverting buffer IN-2 which energizes the coil of a relay R2. The normally open contact of relay R2, illustrated in FIG. 3 as being coupled directly to interface terminal 19, closes, completing the circuit to energize the CREMs 100.

The CREMs remain energized until:

(1) Coinage accepted exceeds the sum of the prices of the maximum number of allowable purchases as determined by the maximum purchase logic to be described hereinafter; or (2) a selection has been made by one of the product selector switches SS-1 to SS-5.

Once the selection is made, the sales transaction is completed. The completion of a selection is determined by the vend motor which includes a cam which opens one of the motor hold switches MH-1 to MH-5 corresponding to one of the associated selector switches which has been actuated. Opening of the motor hold switch unlatches the vend credit relay VCR hold circuit. This condition is then sensed via the microprocessor MP input I-Φ. I-Φ is connected, through an opto-isolator OC2 to the coin mechanism connector pin 6. Coin mechanism connector pin 6 is energized when the vend credit relay VCR is deenergized; or (3) the vending machine is sold out in all columns (all the sold-out switches are open) and this sold-out condition is also sensed via input I-Φ as described above.

When any of these conditions are sensed at I-Φ, O-Φ goes low, permitting the CREMs to de-energize.

VEND CREDIT CAPABILITY

The system of the present invention is designed so that up to three vend credits can be accumulated in the memory of the microprocessor, depending on the price settings of switch bank S-1, S-2, S-3, to be described hereinafter. Once sufficient coinage has been accepted to allow the purchase of a first product, the microprocessor MP output O-5 forces a relay coil R1 via inverting buffer IN-1 to a momentarily energized state. The energization of coil R1 causes the associated relay contact R1'A' to close and R1'B' to open. Closing contacts R1'A' completes the circuit to the vend credit relay coil VCR via coin mechanism connector pin 3. The contacts of vend credit relay coil VCR then change their respective states. That is, the normally open contacts close and the normally closed contacts open. Closing of VCR contacts A completes the vendor circuit through the motor hold switches MH-1 to MH-5 and the sold-out switches 1A to 5A to the vend credit relay coil VCR. The vend credit relay coil VCR will remain energized by this circuit until the motor hold switches MH-1 to MH-5 break the circuit during a vending operation.

Up to this point, the operation description is similar to that of a traditional vendor. However, as stated hereinbefore, with a traditional vendor the CREMs would de-energize, preventing acceptance of additional coinage before money could be accumulated or escrowed toward the purchase of additional products. However, as explained hereinbefore, the multiple purchase discount logic board of the present invention illustrated in FIG. 3, prevents the CREMs from deenergizing at this point in the cycle, and hence allows acceptance of additional coinage towards additional purchases during the same sales transaction.

If enough coinage is accepted to allow a second or additional purchase, a vend credit is held in the microprocessor memory.

If enough additional coinage is accepted to allow a third vend or purchase, an additional vend credit is held in the memory toward this third purchase.

Once the first vend occurs, as sensed via input I-Φ of the microprocessor MP, the vend credit relay coil VCR is energized thereby until the second or third vend occurs and all purchases requested up to three during a single sales transaction have been completed.

DOLLAR ACCEPTANCE CAPABILITY

The multiple purchase discount module of the present invention has the capability of accepting an input from a dollar bill (or coin) validation device DBV, as illustrated in FIG. 3. Microprocessor Input I-6 is normally held at +5 v. by a 10kΩ pull-up resistor. If the resistor is pulled low by a contact closure, the sensing of this change of state increments the internal memory of money accepted by the amount of $1.00.

CUSTOMER INTERFACE DISPLAY

Figure 4:
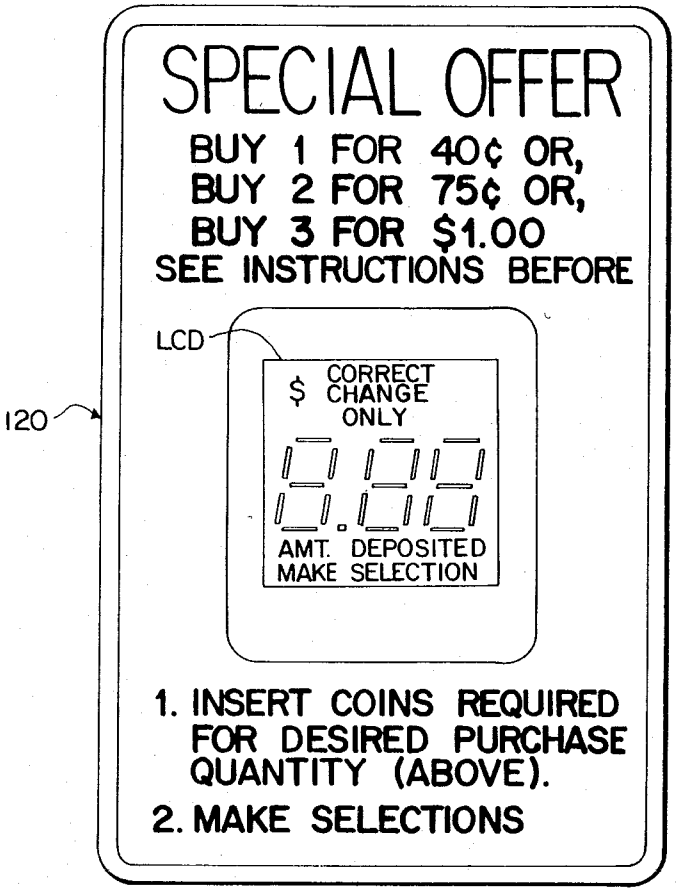
FIG. 4 illustrates one possible embodiment of how a customer display interface would appear on the face of a vending machine of the present invention.

The inclusion of an optional customer interface display 120, as illustrated in FIG. 4, provides for communication between the customer and the machine throughout the sales transaction, informing the customer of the transaction status at each associated step. FIG. 4 illustrates the customer display interface as it would be seen on the face of a vending machine, the central portion representing a liquid crystal display in which a message "correct change only," dollar amounts deposited and the instructions to make a selection appear. If desired, the information around this central portion of the display in FIG. 4 which includes general directions and the type of multiple discount offered, may be applied to the face of the machine surrounding the display by means of a suitable decal. In this manner, this information and offer may be readily changed depending on the price settings set by a service man on the price-setting switches S1 to S3. The nature and operation of the display will be more fully explained hereinafter with reference to the system logic functions.

The display of FIG. 4 may also be utilized to display data associated with the operation of the vend count switch 118 of FIG. 3, which causes the microprocessor MP, when an input is sensed at terminal I-7, to interrupt the operation of the micro-computer and cause the same to display sales data with respect to the number of vends at each respective price which have occured over a period of interest. The vend count switch 118 is mounted within the housing of the coin acceptor mechanism and is not accessible to consumers.

The optional back-up battery 116 ensures the accuracy of the display vend count in that it provides power to the microprocessor MP memory during power outages.

The "correct change only" instruction illustrated in the display of FIG. 4 occurs if input I-8 of microprocessor MP senses closure of the 5¢ tube empty switch ES of the coin mechanism of FIG. 2. I-8 is interfaced to the 5¢ tube empty switch ES by means of an opto-isolator OC1. Closure of the 5¢ tube empty switch ES will cause the microprocessor MP to instruct the liquid crystal display portion illustrated in FIG. 4 to generate the "correct change only" message.

COIN RETURN

The escrow or coin rejector switch 112 illustrated in FIG. 2 is a small mechanical switch mounted behind the coin acceptor plate of the coin mechanism body. Acutation of the externally-mounted coin reject lever causes movement in the coin acceptor plate. This movement causes a contact closure in the coin rejector switch 112. Once these contacts are closed, deposited money can be returned to the consumer via output O-4 of microprocessor MP and the associated coin pay-out motor 108. The conditions under which a coin return or refund may occur are described more fully hereinafter in the detailed description of the system logic functions.

The output O-4 in the associated circuitry within microprocessor MP are also used as the control circuitry for the change return function to be discussed hereinafter.

PRICE-SETTING OPERATION

The price-setting switches S1 to S3 illustrated in FIG. 3 comprise three sets of Dual-In-Line (DIP) switches S1, S2, S3, coupled to the microprocessor MP at input terminals I-1, I-2, I-3, I-4, I-5. Each of the DIP switch groups S1 to S3 contains five discrete switches, the closing of which is correlated to price information such as 5, 10, 20, 40 or 80¢.

The prices for the first, second and third purchases, during a single-sales transaction, are manually set by the serviceman via the switches S1, S2, S3, respectively. Once set, these switches remain closed until manually switched open. Accordingly, a serviceman may set the multiple-purchase discount module for operation in accordance with the "special offer" multiple purchase price information displayed on the decal surrounding the consumer interface display illustrated in FIG. 4.

By way of example, the price of a first product to be purchased during a sales transaction may be set at 50¢; the second purchase price at 45¢ and the third purchase price at 25¢. In this example, a customer could then purchase one product for 50¢, two for 95¢ or three for $1.20. In this example, the first set of DIP switches S-1 would have the 40¢ switch and the 10¢ switch closed for a total price of 50¢. The second set of DIP switches S-2 would have the 40¢ switch and the 5¢ switch closed, indicating a total price of 45¢. The third set of DIP switches would have the 20¢ switch closed and the 5¢ switch closed for a purchase price of 25¢. By using all possible combinations of switches, it is possible to set prices for each purchase according to the following Table:

TABLE A

| Switches | | | | | |
|---|---|---|---|---|---|
| 5¢ | 10¢ | 20¢ | 40¢ | 80¢ | Purchase Price |
| X | | | | | 5¢ |
| | X | | | | 10¢ |
| X | X | | | | 15¢ |
| | | X | | | 20¢ |
| X | | X | | | 25¢ |
| | X | X | | | 30¢ |
| X | X | X | | | 35¢ |
| | | | X | | 40¢ |
| X | | | X | | 45¢ |
| | X | | X | | 50¢ |
| X | X | | X | | 55¢ |
| | | X | X | | 60¢ |
| X | | X | X | | 65¢ |
| | X | X | X | | 70¢ |
| X | X | X | X | | 75¢ |
| | | | | X | 80¢ |
| X | | | | X | 85¢ |
| | X | | | X | 90¢ |
| X | X | | | X | 95¢ |
| | | X | | X | 100¢ |
| X | | X | | X | 105¢ |
| | X | X | | X | 110¢ |
| X | X | X | | X | 115¢ |
| | | | X | X | 120¢ |
| X | | | X | X | 125¢ |
| | X | | X | X | 130¢ |
| X | X | | X | X | 135¢ |
| | | X | X | X | 140¢ |
| X | | X | X | X | 145¢ |
| | X | X | X | X | 150¢ |

TABLE A-continued

| Switches | | | | | |
|---|---|---|---|---|---|
| 5¢ | 10¢ | 20¢ | 40¢ | 80¢ | Purchase Price |
| X | X | X | X | X | 155¢ |

NOTE:
X INDICATES CLOSED SWITCH

The microprocessor MP scans or reads the price setting switches S1 to S3 by a standard strobing or multiplex type of operation. This operation is essentially as follows: Input lines I-1 through I-5 are normally held at +5 v. by the price-setting pull-up resistors PR. Output lines O-1 through O-3 are switched to ground one at a time as they are strobed by the microprocessor MP under control of the program therein. When output O-3 is switched to ground (0 volts), the first price-setting switches S1 are given a path to ground, and the inputs I-1 to I-5 sense this path to ground only if the price-setting switch connected to the particular input is closed. Output O-2 is used, for the second price-setting switch S2 and O-1 is operatively associated with the third price-setting switches S3.

The diode attached to the normally open side of each price-setting switch prevents the +5 v. from back-feeding through closed switches, which would result in faulty readings. As will become more fully apparent hereinafter, when described in connection with the specific system logic functions, the relative values of the price-setting switches S1 to S3 determine whether a one-for, two-for, or three-for purchase is available to a customer, and prices for each of the respective categories.

PAY-OUT MOTOR CIRCUITRY

When pay-out is to be given, either due to change or refund, output O-4 of microprocessor MP forces the two parallel inverting buffers IN-3 ON. Turning the buffers ON connects the pay-out motor 108 of FIG. 2 to ground. This completed circuit through the pay-out motor 108 causes the motor pulse/carry switch 110 to open as each nickel is ejected from the pay-out tubes. As will be described hereinafter, a visual display on display 120 occurs each time a nickel is ejected. Closure of the motor pulse/motor carry switch 110 provides I-10 with a path to ground. When this switch is open, I-10 is pulled to +5 v. by the associated pull-up resistor. The microprocessor MP memory which stores the amount of change of escrow due, is decremented by 5¢ with each opening of the switch 110.

The switch 110 also ensures that the pay-out motor 108 completes the transaction cycle by providing the pay-out motor with a path to ground until the motor cam opens the path to ground. An inventory switch 106 is provided for service persons so the pay-out motor 108 may be normally energized for testing purposes.

COIN-ACCEPTOR SWITCHES 104

Coins are accepted or rejected by the coin acceptor plate of the coin mechanism and are separated into denominations of 5, 10 and 25¢, as illustrated by the coil switches 104. As the accepted coins fall through the 5, 10 or 25¢ channels of the switches 104, the coin trips a switch wire which momentarily opens the 5, 10 or 25¢ switch contact.

Inputs I-11, I-12, and I-13 are normally switched to ground by the 5, 10 and 25¢ switches. Opening of the switch contacts causes the input to be pulled to +5 v. by the pull-up resistor. As these inputs are switched, the MP microprocessor increments the escrow memory by the appropriate amount deposited. It is in this manner that escrow credit is established towards purchases to be made.

POWER SUPPLY

Figure 5:
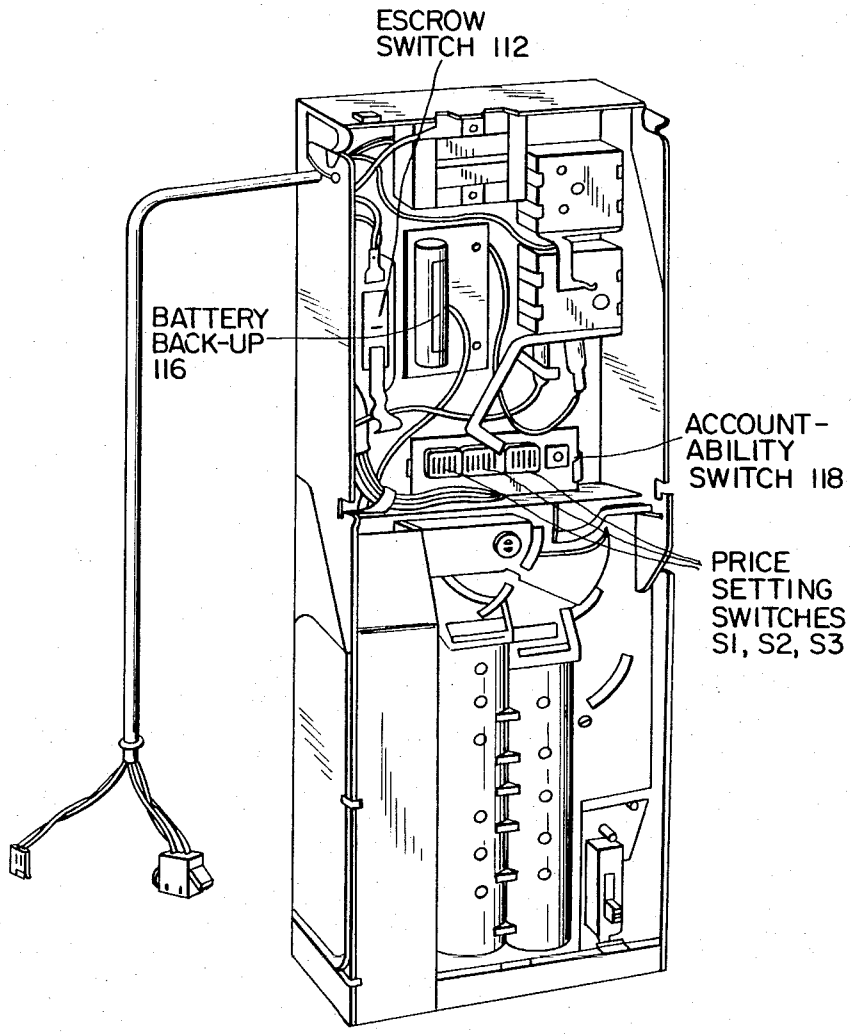
FIG. 5 shows one possible arrangement of some of the components of the coin mechanism of the vending machine within the interior of its housing.

The coin mechanism circuitry of FIG. 2 contains a transformer that provides the logic board of FIG. 3 with 24 VAC. This 24 VAC is converted by the circuitry of the power supply P.S.A' to 20 VDC. The 20 VDC is converted by P.S.B' to 5 VDC. As stated hereinbefore, an optional 5 v. battery 116 can be provided to provide back-up power. The optional battery 116, Escrow switch 112, Accountability switch 118, and price-setting switches S1–S3 are all mounted within the coin mechanism as illustrated in FIG. 5, making them inaccessible to customers.

SYSTEM LOGIC FUNCTIONS

As stated hereinbefore, the microprocessor MP of FIG. 3 has an internal program which operates on the inputs on terminals I, and then generates outputs that control the coin mechanism of FIG. 2 and the vendor control circuitry of FIG. 1. Since it is well within the ordinary skill of a computer programmer to write sufficient software to implement the preferred logic functions of the present invention, specific programs will not be discussed hereinafter. However, a narrative description of the logic functions and their intended operation will be described to facilitate a programmer to readily compose a program appropriately correlated with any type of microprocessor utilized.

In a preferred embodiment of the present invention, a maximum of three packages can be dispensed in a single sales transaction. As described hereinbefore, the price per package is set by means of the three sets of binary DIP switches S1 to S3. The maximum price setting per set of switches in a preferred embodiment of the present invention is $1.55. By setting the individual price per package with switches S1 to S3, the microprocessor MP adds the individual price settings and allows escrow up to 20¢ above the total accumulated vend price. After this total is reached, the coin mechanism of FIG. 2 will no longer accept coins because microprocessor MP generates a signal at terminal I-Φ to de-energize the CREMs. The customer can then randomly push the selection buttons SS1-1 to SS-5 as many times as credit has been established in the memory of MP and receive vended products from those selections. Once the escrowed credit in the memory of MP is decremented with purchases to an amount below that required for a purchase, the remaining credit is returned via the pay-out tubes as change. The microprocessor MP can be set to allow for a one-for, two-for, or three-for purchase. A one-for price setting on switches S1 will allow escrow of credit up to 20¢ above the first price setting. The two-for price setting allows escrow of credit up to 20¢ above the total of the first and second price setting. The three-for price setting allows escrow of credit up to 20¢ above the total of the first, second, and third price settings.

Using the binary DIP switch sets S1 to S3, the following price settings will allow the respective one-for, two-for and three-for functions described above:

TABLE B

| | |
|---|---|
| Case 1 | If the second price setting is greater |

TABLE B-continued

| | |
|---|---|
| | than the first, the unit maintains a one-for capability. No multiple purchase capability from this setting. |
| Case 2 | If the second price setting is equal to the first and the third is greater than or equal to the second, the unit maintains a one-for capability. |
| Case 3 | If the second price setting is less than the first, and the third is greater than or equal to the second, the unit maintains a one-for capability. |
| Case 4 | If the second price setting is less than the first and the third is equal to or less than the second, the unit maintains a two-for or three-for option. |
| Case 5 | If the second price setting is equal to the first and the third is less than the second, the unit maintains a two-for or three-for option |
| Case 6 | If all the price settings are zero, the vendor will require no money to vend. This is referred to as free vend. |

If a customer wishes to utilize the multiple purchase feature offered by the vending machine of the present invention in accordance with the price settings of the switches S1 to S3, he must first escrow sufficient credit for at least the first product to be purchased. Once a selection is made of the products by selector switches SS-1 to SS-5, the transacation is considered complete because the CREMs become de-energized and will not allow the acceptance of any further money until all the credit is cleared by the appropriate selections being made or change returned. If more than one product is to be purchased, the customer may elect to utilize one or two options of the possible transaction. As in the two-for or three-for setting, it is possible to make only a single selection, or in the case of the three-for setting, only two selections can be made. In all cases, however, the transaction is completed once credit is established and a selection is made. The multiple purchase option cannot be utilized and repeated for successive single vend transactions, but rather is only available during a single sales transaction.

The system of the present invention also has the capability to return escrowed credit up to the first vend price. If credit has not been established, the coin return lever can be pressed and the credit will be returned. However, once credit is established, change is returned only when the credit exceeds the total price accumulated for the type of transaction desired. For example, if the settng was one for 40¢, two for 75¢ and three for $1.00, and a customer deposited 85¢, 10¢ change would automatically be returned after the second selection was made. In all cases of the one-for, two-for or three-for option, once any level of credit is established, a selection must be made according to that level of credit established.

In a case where total machine sold-out occurs, accompanied by the opening of switch contacts 1A,B to 5A,B of FIG. 1 while a sales transaction is in progress, the escrowed credit will be automatically returned via the change return mechanism, namely, pay-out motor 108. However, if only one or several columns becomes sold out during a transaction, an alternate selection must be made, as no credit will be returned.

As described hereinbefore, the multiple purchase discount module of the present invention may be interfaced with a liquid crystal display and accountability switch 118 to display the number of vends made at the different respective price settings of the switches. This accountability feature is activated in accordance with the logic in microprocessor MP to flash the number of vends at the first price setting on the liquid crystal display of display means 120, pause, and then flash the number of the second setting, pause, and finally flash the number of the third setting. The system of the present invention is capable of displaying from zero to one thousand, nine hundred ninety-nine vends and then reset to zero. For a four-digit number, the dollar symbol of the display is utilized to designate the one thousand quantity.

The following transaction examples are provided to provide a more complete understanding of the present invention. The left-hand column represents steps formed by a customer during a sales transaction; the center column information displayed on the LCD screen of FIG. 4 during the sales transaction; and the third column, the logic sequence performed by the combined circuitry of FIGS. 1 to 3.

| CUSTOMER ACTION | LCD | LOGIC SEQUENCE |
|---|---|---|
| | TRANSACTION EXAMPLE 1: | |
| | $.40 | CREM ENERGIZED |
| DEPOSIT COINS | | |
| | 25¢ $.25 | |
| | AMOUNT DEPOSITED | |
| | 10¢ $.35 | |
| | AMOUNT DEPOSITED | |
| | 5¢ $.40 | 1ST CREDIT ESCROW |
| | AMOUNT DEPOSITED | |
| | 25¢ $.65 | |
| | AMOUNT DEPOSITED | |
| | 25¢ $.90 | 2ND CREDIT ESCROW |
| | AMOUNT DEPOSITED | |
| | 25¢ $1.15 | 3RD CREDIT ESCROW |
| | MAKE SELECTION | CREM DE-ENERGIZED |
| PUSH ANY SELECTION BUTTON | MAKE SELECTION | VEND PRODUCT, INCREMENT ACCUMULATOR #1 |
| PUSH ANY SELECTION BUTTON | MAKE SELECTION | VEND PRODUCT, INCREMENT ACCUMULATOR #2 |
| PUSH ANY SELECTION BUTTON | | VEND PRODUCT, INCREMENT ACCUMULATOR #3 |
| | CHANGE | RETURN ESCROW |
| | $.15 | CREDIT IN 5c |

-continued

| CUSTOMER ACTION | LCD | LOGIC SEQUENCE |
|---|---|---|
| | | INCREMENTS |
| | CHANGE | |
| | $.10 | |
| | CHANGE | |
| | $.05 | |
| | CHANGE | |
| | $.00 | |
| | CHANGE | CREM ENERGIZED |
| | $.40 | |
| | TRANSACTION EXAMPLE 2: | |
| | $.40 | CREM ENERGIZED |
| DEPOSIT COINS | | |
| | 25¢ $.25 | |
| | AMOUNT DEPOSITED | |
| | 10¢ $.35 | |
| | AMOUNT DEPOSITED | |
| PRESS COIN RETURN | CHANGE | RETURN COIN |
| | $.35 | CREDIT IN 5¢ |
| | CHANGE | INCREMENTS CREM |
| | $.30 | DE-ENERGIZED |
| | . | |
| | . | |
| | . | |
| | . | |
| | . | |
| | CHANGE | |
| | $.00 | |
| | $.40 | CREM ENERGIZED |
| | TRANSACTION EXAMPLE 3: | |
| | $.40 | CREM-ENERGIZED |
| DEPOSIT COINS | | |
| | 25¢ $.25 | |
| | AMOUNT DEPOSITED | |
| | 25¢ $.50 | |
| | AMOUNT DEPOSITED | 1ST CREDIT ESCROW |
| PRESS COIN RETURN | $.50 | |
| | AMOUNT DEPOSITED | NO ACTION |
| | 10¢ $.60 | |
| | AMOUNT DEPOSITED | |
| | 25¢ $.85 | |
| | AMOUNT DEPOSITED | 2ND CREDIT ESCROW |
| PUSH ANY SELECTION BUTTON | MAKE SELECTION | VEND PRODUCT, INCREMENT ACCUMULATOR 1 CREM DE-ENERGIZED |
| PRESS COIN RETURN | MAKE SELECTION | NO ACTION |
| PRESS SOLD OUT SELECTION | MAKE SELECTION | NO ACTION |
| PUSH ANY SELECTION BUTTON | CHANGE | VEND PRODUCT, INCREMENT ACCUMULATOR 2 |
| | $.10 | |
| | CHANGE | |
| | $.05 | |
| | CHANGE | |
| | $.00 | |
| | $.40 | CREM ENERGIZED |
| | TRANSACTION EXAMPLE 4: | |
| | $.40 | CREM ENERGIZED |
| DEPOSIT COINS | | |
| | 25¢ $.25 | |
| | AMOUNT DEPOSITED | |
| | 25¢ $.50 | 1ST CREDIT ESCROW |
| | AMOUNT DEPOSITED | |
| | 25¢ $.75 | 2ND CREDIT ESCROW |
| | AMOUNT DEPOSITED | |
| PUSH ANY SELECTION BUTTON | | VEND PRODUCT, INCREMENT ACCUMULATOR #1 DE-ENERGIZE CREM |
| | * TOTAL MACHINE SOLD OUT OCCURS * | |
| | CHANGE | |
| | $.35 | |
| | CHANGE | |
| | $.30 | |
| | CHANGE | |
| | $.25 | |
| | CHANGE | |
| | $.20 | |
| | . | |
| | . | |

-continued

| CUSTOMER ACTION | LCD | LOGIC SEQUENCE |
|---|---|---|
| | CHANGE $.00 | |
| WILL NOT ACCEPT COINS | — | CREM DE-ENERGIZED |

The system of the present invention, having being thus described, it should be understood that it may be modified as would occur to one of ordinary skill in the art without departing from the spirit and scope of the present invention.

What is claimed is:

1. In a vending machine for vending a plurality of products each of which is sold for the same first predetermined product price if purchased individually during different sales transactions, the improvement comprising:

first manually adjustable price-setting digital switching means for generating a digital price code for establishing said first predetermined product price for the vend of a single product and second manually adjustable price-setting digital switching means for generating a price code for establishing a second price for a second product when two products are collectively purchased during a single sales transaction, said second price being less than said first product price;

accumulator means for receiving money during said single sales transaction and establishing credit toward the purchase of said products;

escrow memory means for storing escrow credit established by said accumulator means toward the purchase of one or more products during a single sales transaction;

credit detector means for determining when said escrow credit is at least equal to said first predetermined product price and for determining when said escrow credit equals the total of said first predetermined product price and said second price;

product selector means for initiating the vend of one or more of said products following the insertion of all money related to said single sales transaction; and vend discharge control means responsive to said credit detector means for enabling the vend of one product if said credit detector means determines that the escrow credit established in said escrow means at least equals said first predetermined product price and for enabling the vend of two products during said single sales transaction if said escrow detector means determines that said escrow credit is at least equal to the total of said first predetermined product price and said second price.

2. The vending machine of claim 1, further comprising:

change return means for returning a value of coins received during said sales transaction which is in excess of the cumulative total of escrow credit established in said escrow memory means during said transaction.

3. The vending machine of claim 2, further comprising:

means for inhibiting the operation of said change return means after escrow credit is established at least equal to said first predetermined product price until said product selector means is actuated a number of times commensurate with the total product credit established in said escrow memory means.

4. The vending machine of claim 3 wherein said means for inhibiting comprises:

credit reduction means for decrementing the total credit established in said escrow memory means in response to each initiation of a vend by said product selector means; and means for enabling said change return means only when the total credit in said escrow memory means falls below said first predetermined product price.

5. The vending machine of claim 1 further comprising:

coin rejector means for precluding the receipt of coins by said accumulator means and for returning the same to a customer in response to escrow credit established in said escrow memory means of a predetermined excess above the total of said first predetermined product price and said second price.

6. The vending machine of claim 1, further comprising:

coin rejector means for precluding the receipt of coins by said accumulator means and returning the same to a customer in response to one or more initiations of vends by said product selector means.

7. The vending machine of claim 1, further comprising logic means for comparing the digital price codes set by said digital switching and means determining the number of vends which can be made by said machine during a single sales transaction as a function of said digital price codes set.

8. The vending machine of claim 2, further comprising means for enabling said coin return means to automatically refund coins received during said single sales transaction if said machine becomes completely sold out of products during said transaction.

9. The vending machine of claim 1, further including display means for advising and instructing a customer as to the status and sequence of vend operations occurring during said single sales transaction.

10. The vending machine of claim 9, further including accountability means for storing sales transaction data in said escrow memory means according to the number of vends which have occurred at each respective vend price set by said price setting means.

11. The vending machine of claim 1, further including a primary power source and a secondary power source, said secondary power source providing power to at least said escrow memory means if power from said primary power source is interrupted.

12. The vending machine as in claim 1, further comprising:

at least third price setting switching means for establishing at least a third price for additional products when at least three products are collectively purchased during a single sales transaction, said third price being lower than said first and second prices;

wherein said credit detector means determines when said escrow credit equals a second total of said first, second and at least said third prices; and said vend discharge control means enables the vend of at least three products during said single sales transaction if said escrow detector means determines that said escrow credit is at least equal to said second total.

13. The vending machine of claim 12, further comprising coin rejector means for precluding the receipt of coins by said accumulator means and for returning the same to a customer in response to escrow credit established in said escrow memory means of a predetermined excess above said second total.

14. A vending machine for vending goods in discrete sales units, each unit comprising one or more articles, comprising:

a first manually adjustable digital price setting switching device for generating a digital price code for setting a first sales price for a first unit vended in a single sales transaction;

a second manually adjustable digital price setting switching device for generating a digital price code for setting a second price for a second unit when two units are vended in a single sales transaction;

first means for receiving and determining the amount of currency deposited by a purchaser during a sales transaction; and second means for determining if said amount deposited equals or exceeds said first price and for permitting a purchaser to select one unit when said amount deposited equals or exceeds said first price, and for determining if said amount deposited equals or exceeds the sume of said first and second prices and for permitting a purchaser to select two units when said amount deposited exceeds said sum.

15. The vending machine of claim 14 wherein said second price is lower than said first price.

16. The vending machine of claim 14, further comprising a third price setting switching device for setting a third price for a third sales unit when three units are vended in a single sales transaction;

said second means comprising means for determining if said amount deposited equals or exceeds the sum of said first, second and third prices and for permitting a purchaser to select three units if said amount deposited equals or exceeds said sum of said first, second and third prices.

17. The vending machine of claim 16, wherein said third price is lower than said first and second prices.

* * * * *